US006029669A

United States Patent [19]

Hammock

[11] Patent Number: 6,029,669

[45] **Date of Patent: *Feb. 29, 2000**

[54] MODIFIED BARIUM SWALLOW BOARD

[76] Inventor: Richard Dale Hammock, 353 Lee St., Barnesville, Ga. 30204

[ * ] Notice: This patent is subject to a terminal disclaimer.

[21] Appl. No.: 08/060,658

[22] Filed: Jul. 23, 1993

[51] Int. Cl.[7] ..... A61G 15/00

[52] U.S. Cl. ..... 128/845; 128/846; 297/377

[58] Field of Search ..... 128/845, 870, 128/869, 846; 297/377; 5/633, 634

[56] References Cited

U.S. PATENT DOCUMENTS

| | | | |
|---|---|---|---|
| 2,208,945 | 7/1940 | Miller | 297/377 |
| 2,281,629 | 5/1942 | Snow | 128/845 |
| 2,387,357 | 10/1945 | Rogerson | 5/634 |
| 2,777,138 | 1/1957 | Gallagher | 297/377 |
| 3,276,817 | 10/1966 | Marple | 297/377 |
| 3,339,974 | 9/1967 | Park | 297/377 |
| 3,431,020 | 3/1969 | Tyndall | 297/377 |
| 4,660,237 | 4/1987 | Bradnax | 297/377 |
| 4,853,993 | 8/1989 | Walpin | 5/634 |
| 4,974,905 | 12/1990 | Davis | 297/377 |

*Primary Examiner*—Michael A. Brown
*Attorney, Agent, or Firm*—Dority & Manning, P.A.

[57] ABSTRACT

A portable and selectively positionable swallow board is provided. The swallow board includes a substantially rigged seat portion. A substantially back portion is positionable with respect to the seat portion to a first position in which a seat portion and the back portion are aligned to support a patient in a supine position. A support mechanism is in operative communication with the back portion to secure the back portion in at least one second position at an angle less than 180°, and at least approximately 90°, with respect to the seat portion to support a patient in a raised position.

2 Claims, 1 Drawing Sheet

MODIFIED BARIUM SWALLOW BOARD

BACKGROUND OF THE INVENTION

The present invention relates to patient support systems used in connection with radiological, x-ray and fluoroscopic examinations of patients with dysphagia. More particularly, the invention relates to a portable device used to support and position the body of patients afflicted with dysphagia.

Generally, dysphagia refers to a condition in which a patient has difficulty swallowing. Most often, such condition results from events such as cardiovascular accidents, cancer, post-radiation treatment, cervical spurring and esophageal spasms which effect the function of the esophagus. Treatment for dysphagia conditions often involve radiological examinations in which a radiopaque agent, for example a barium solution, is administered orally to a patient to allow examination of the digestive system by x-ray or other radiological equipment.

Typically, such equipment includes a radiation source and a background surface between which the patient is disposed. Chair-like devices are used to position a patient between the source and the background surface. Typically, however, such chairs are bulky. Because the space between the radiation source and the background surface is limited, the space available for the patient in the chair is also limited. Thus, such chairs are often inadequate for larger patients. In addition, where patients are brought to the testing area on support structures such as a stretcher or gurney, the patient must be transferred to the chair.

SUMMARY OF THE INVENTION

The present invention recognizes and addresses the foregoing disadvantages, and others, of prior art constructions and methods.

Accordingly, it is an object of the present invention to provide an improved patient support device to selectively support a patient during radiological examination.

It is a further object of the present invention to provide a patient support device which may be used in conjunction with an existing support structure so that the patient need not be moved from one structure to another.

Some of these objects are achieved by a portable and selectively positionable swallow board. The swallow board includes a substantially rigid seat portion. A substantially rigid back portion is disposed with respect to the seat portion so that the back portion is positionable with respect to the seat portion to a plurality of positions, the back portion in each position being disposed at an angle at most approximately 1800 ° and at least approximately 90° with respect to the seat portion. A support mechanism is in operative communication with the back portion to secure the back portion in each position to support a patient disposed on the seat portion and the back portion.

The accompanying drawings, which are incorporated in and constitute a part of the specification, illustrate one embodiment of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
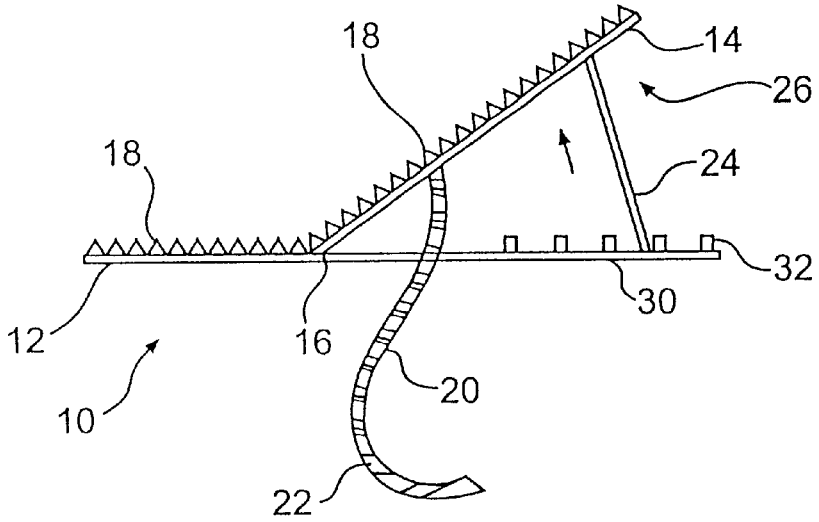
FIG. 1 is a side plan view of the swallow board constructed in accordance with the present invention and disposed to support a patient in a raised position.

Repeat use of reference characters in the present specification and drawings is intended to represent the same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
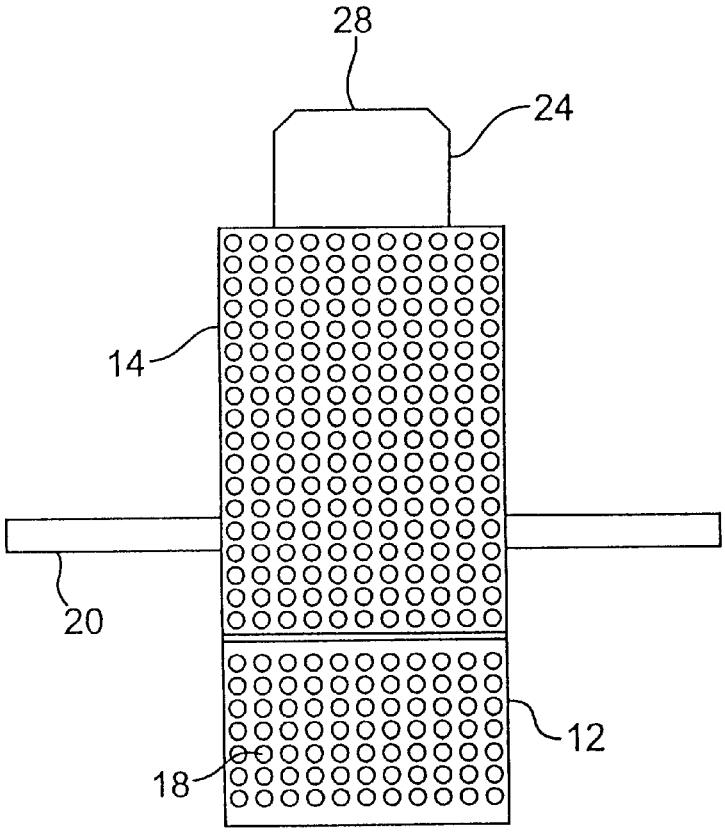
FIG. 2 is a top view of the swallow board as in FIG. 1 in which the back portion is lowered and a support arm is rotated above the back portion.

Referring to FIGS. 1 and 2, a swallow board 10 may be used to determine feeding positions for patients who have eating problems relating to swallowing disorders, for example caused by disease or stroke. In this embodiment, board 10 includes a seat portion 12 attached to a back portion 14 by two 3" brass door hinges indicated at 16. Seat portion 12 is part of a base 30, which may be constructed from a piece of CDX ¾" plywood, 48"×16". Back portion 14 may be constructed from a similar piece of plywood cut 29"×14". In one preferred embodiment as illustrated in the figures, the seat portion defines a 16"×16" square. The hinges are attached to the seat portion and back portion by six brass 3/32" screws.

The seat and back portions are cushioned, in this case with eggcrate foam padding 18. The padding is 1¾" padding cut to the dimensions of the back portion and seat portion. A nylon safety strap 20, preferably 38"–42" in length, is attached to the back of back portion 14 so that opposite ends of the strap extend from either side of the back portion. Fourteen velcro sets 22 are adhesively secured to strap 20 so that a patient disposed on board 10 may be secured thereto.

Seat portion 12 and back rest 14 are coated by interior/exterior latex gloss enamel, color sand true test X-0 rust enamel, color gloss black.

A support mechanism includes a U-shaped bar 24 attached at its open end to back portion 14 by two tight pin ½" zinc plated hinges indicated at 26 and attached to the back portion 14 by three 3/32" zinc plated screws. A single hinge may be used instead of the two hinges if the hinge has the appropriate width. The bar is constructed from ⅜" steel and extends 23½" from its open end to its closed end 28.

Base 30 extends rearward from its seat portion 12. Two parallel rows of five spaced apart stops 32 are disposed on base 30 to receive closed end 28 of bar 24 in any of five positions. Each stop 32 comprises a 6×¾" steel-zinc wood screw. A hand painted number 45, 55, 65, 75 or 90 is placed by each stop 32 to indicate the angle defined between back portion 14 and base 30 when closed end 28 of bar 24 is received by the respective pair of stops. Bar 24 is attached to back portion 14 such that, referring to FIG. 1, when the bar is received by the rightmost pair of stops 32, the angle between back portion 14 and base 30 is 45°. When bar 24 is received by the leftmost pair of stop 32, the angle is 90°. Each stop, from right to left up to the last stop, represents an increase of 10° in the angle between the back portion and the base. There is a 15° increase to the leftmost stop.

Referring specifically to FIG. 2, bar 24 may swing outward so that it extends beyond the top of back portion 14 to enable the board to be placed in a flat position in which back portion 14 is aligned parallel to seat portion 12. In this flat position of the board, back portion 14 is disposed at a 180° angle with respect to seat portion 12. This angle is reduced when the back portion is raised to one of the positions defined by the placement of free end 28 of arm 24 at one of the pairs of stops 32 as described above. Accordingly, from the uprightmost to the flat position, back portion 14 is selectively positionable at predetermined angular increments with respect to seat portion 12 from 90° to 180°.

Other parts employed in the construction of board 10, but not discussed explicitly above, include two steel-zinc machine screws 10–24×¾"; two hex nuts steel-zinc 10–24; two slotted round head machine screws steel-zinc ¼–20×½; two hex nuts 10–24 steel-zinc course-24; and five 8" aluminum L-shape thick angle ¾"×¾"×⅛".

In operation, board 10 can safely and comfortably secure patients in proper positions for analysis of their swallowing disabilities. In a fluoroscopic examination, for example, foods of varying consistency ranging from thin liquid to thick pudding and mixed with barium sulphate is swallowed by a patient sitting on board 10. The process is repeated with the back portion 14 disposed in each of the five raised positions (90°, 105°, 115°, 125° and 135° with respect to seat portion 12). Using a fluoroscopy system, a physician and a speech pathologist examine the patient while swallowing to determine which of the five positions, and which food consistency, is proper for the patient. After the optimal back position and food consistency is determined, the patient may be thereafter fed under these conditions.

While one or more preferred embodiments of the invention have been described above, it should be understood that any and all equivalent realizations of the present invention are included within the scope and spirit thereof. The embodiments depicted are presented by way of example only and are not intended as limitations on the present invention. It should be understood by those of ordinary skill in this art that the present invention is not limited to these embodiments since modifications can be made. Therefore, it is contemplated that any and all such embodiments are included in the present invention as may fall within the literal or equivalent scope of the appended claims.

I claim:

1. A method of examining patients having swallowing disorders, said method comprising the steps of:

(a) disposing a said patient on a portable and selectively positionable swallow board that is constructed independently of any wheeled conveyance structure, said swallow board having a substantially rigid seat portion, a substantially rigid back portion disposed with respect to said seat portion so that said back portion is positionable with respect to said seat portion to a plurality of positions, said back portion in each said position being disposed at an angle at most approximately 180° and at least approximately 90° with respect to said seat portion, and a support mechanism in operative communication with said back portion to secure said back portion in each said position to support a patient disposed on said seat portion and said back portion;

(b) disposing said back portion at a first said position;

(c) administering to said patient a substance having a radiopaque agent so that said patient swallows said substance;

(d) radiologically examining said patient's digestive system;

(e) disposing said back portion in at least one second said position in which said back portion is disposed at a said angle with respect to said seat portion that is different from the said angle at which said back portion is disposed in said first position;

(f) performing steps (c) and (d) for each said at least one second position; and (g) determining, from steps (d), the optimal of said first and said at least one second positions in which to dispose said back portion with respect to said seat portion when feeding a said patient disposed on said swallow board.

2. The method as in claim 1, wherein said step (c) includes administering to said patient a said substance including barium sulphate.

* * * * *

UNITED STATES PATENT AND TRADEMARK OFFICE

CERTIFICATE OF CORRECTION

PATENT NO : 6,029,669
DATED : February 29, 2000
INVENTOR(S) : Richard D. Hammock It is certified that error appears in the above-identified patent and that said Letters Patent are hereby corrected as shown below:

Column 1, line 50 change "1800°" to --180°--.
Column 2, line 50 change "½"" to --2½"--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*